United States Patent [19]

Johansson

[11] 4,002,330

[45] Jan. 11, 1977

[54] PATIENT SUPPORTING TABLE

[76] Inventor: Hans Arne V. Johansson, Treharadsvagen 36, Eslov, Sweden, S-241 OO

[22] Filed: Dec. 5, 1975

[21] Appl. No.: 638,059

[52] U.S. Cl. ..... 269/327; 5/12 C; 5/60; 5/317 D

[51] Int. Cl.[2] ..... A47C 27/08

[58] Field of Search ..... 269/322, 327; 5/12 C, 5/60, 284, 93 R, 93 B, 317 D

[56] References Cited

UNITED STATES PATENTS

| | | | |
|---|---|---|---|
| 3,585,660 | 6/1971 | Gottfried et al. | 5/60 |
| 3,800,342 | 4/1974 | Tenteris et al. | 5/60 |

FOREIGN PATENTS OR APPLICATIONS

| | | | |
|---|---|---|---|
| 512,811 | 5/1955 | Canada | 269/327 |

*Primary Examiner*—Al Lawrence Smith
*Assistant Examiner*—Robert C. Watson
*Attorney, Agent, or Firm*—John J. Dennemeyer

[57] ABSTRACT

A supporting table for a recumbent patient has a table plate provided at least along the side edges, and preferably also at the head and foot edges, with a gate member which is pivotally mounted so that it can be fixed in an up position. In this position the gate members not only keep a patient from rolling off the table but they cooperate with a mattress on the table to form a trough in which water may be retained for bathing the patient. The mattress has an outlet for discharging the water after bathing. In the down position of the gate members the mattress edges are also folded downwardly.

12 Claims, 6 Drawing Figures

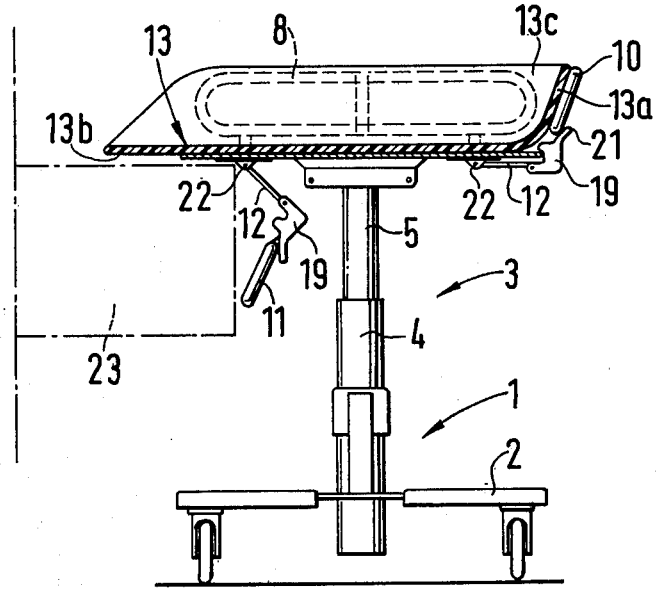
Fig. 2
Fig. 3
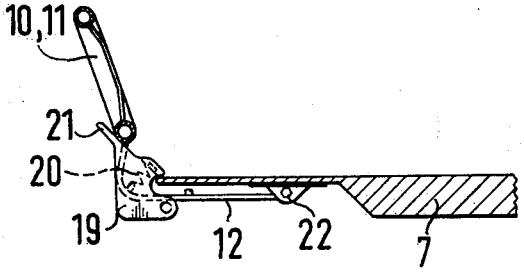
Fig. 4
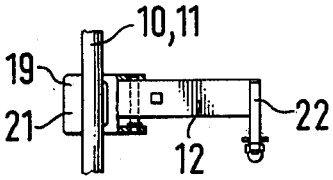

PATIENT SUPPORTING TABLE

The present invention relates to supporting tables for recumbent patients, particularly to improvements in the table plate for such tables, and of the kind comprising at least one barrier or gate member which is mounted to be pivotally movable between an operative position in which it extends as a safeguard barrier entirely or partially above the plane of the table plate, and an inoperative position below said plane.

Prior art equipment of this type which is provided with barrier or gate members is very useful to prevent a patient lying on the supporting table from falling down for some reason or other. In cases where the equipment is of simple construction merely a fall-down preventing function has been obtained, and in cases where the equipment could be considered to be capable of further functions, such as splash-guarding functions, they are frequently costly and of a bulky construction.

It is therefore an object of the present invention to obviate these drawbacks and to improve patient-supporting tables by an arrangement which in an extremely simple way will allow falldown preventing and splash guarding functions to be obtained, if desired.

The invention will be explained in greater detail hereinafter with reference to the accompanying drawings, in which:

FIG. 2 illustrates the patient conveyance table of FIG. 1 in an end elevation;

FIG. 3 illustrates a barrier or gate member mounted on the patient table through the intermediary of a locking device;

FIG. 4 is a plan view of the barrier or gate locking device;

Figure 1:
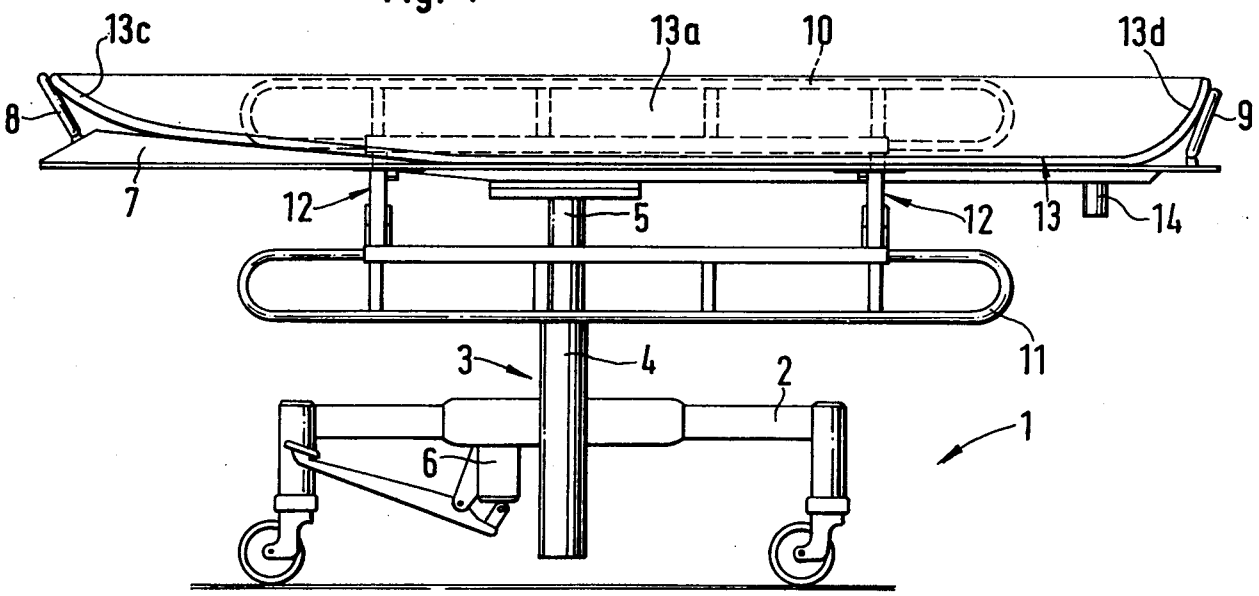
FIG. 1 is a side-elevational view illustrating a patient conveyance table provided with the improved arrangement according to the invention.
Figure 5:
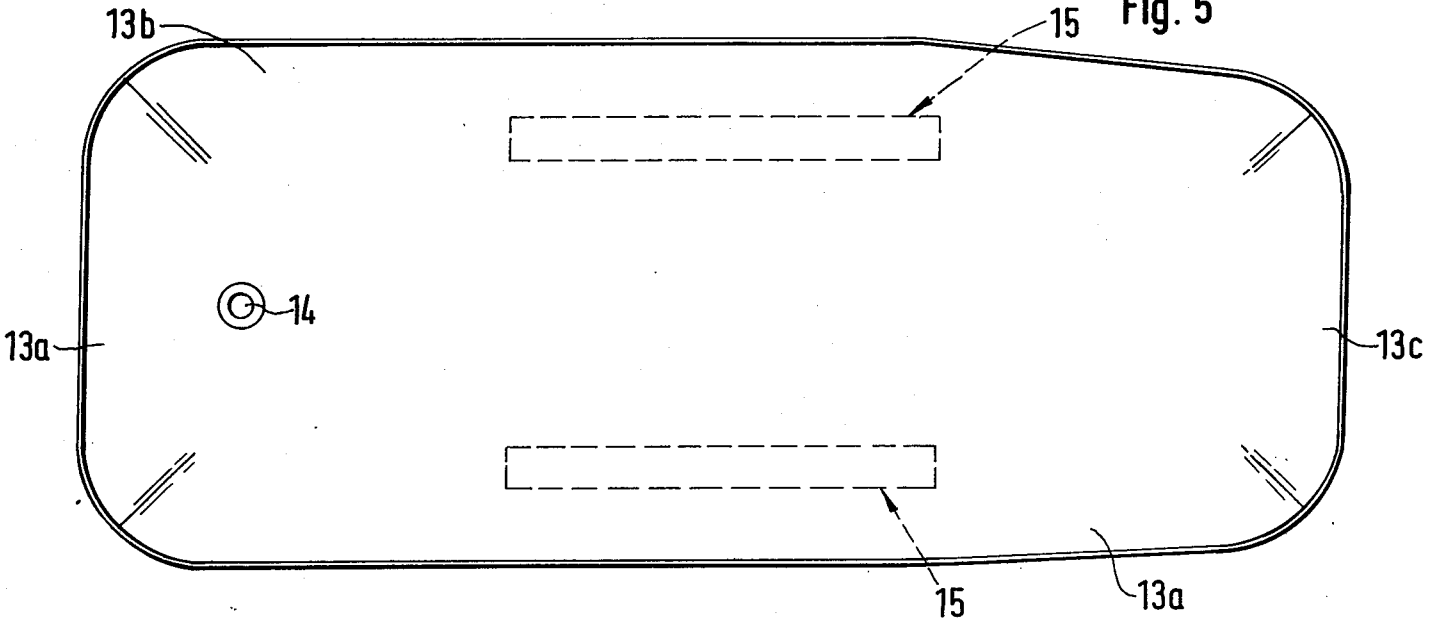
FIG. 5 is a plan view of a mattress adapted to be positioned on the patient table.
Figure 6:
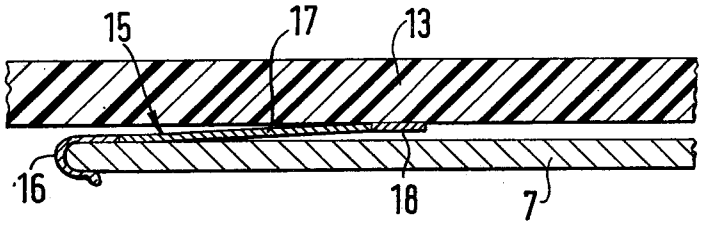
FIG. 6 is a cross-section through a portion of the mattress and a holder retaining the mattress to the table plate.

The conveyance table illustrated in the drawings comprises a carriage 1 including a wheeled chassis 2 mounted on a lifting device 3. The latter comprises a pressure cylinder 4, a piston 5 projecting upwards from the cylinder, and a pedal controlled actuator 6 for raising the piston 5 and the table plate 7 mounted on the piston. The function of the conveyance table is already well known in the art, and therefore need not be described specifically.

Mounted on the table plate 7 are barrier members in the form of gates 8, 9, 10 and 11, the gates 8, 9 extending along the head and foot ends of the plate 7 being rigidly mounted, whereas the gates 10, 11 extending along the longer sides of the table plate 7 are mounted by means of holders 12 so as to be raised to serve as safety barriers along the table plate 7, and to be lowered from such raised positions into positions below the table plate 7.

The apparatus thus described can be employed as a mobile unit comprising a table plate for supporting a recumbent patient and equipped with fall-down protecting members as well as a simplified arrangement for facilitating the transfer of patients to and from the table plate.

In order that this simple and practical apparatus can be used, without the necessity of any costly constructional modifications also for giving splash-free showers besides an unimpeded transfer of patients to and from the patient table 7, at least one of the gates when in its operative position as a safeguard member cooperates according to the invention with a mattress 13, made of water-resistant material, for instance a plastic material which is detachably connected to the table plate 7, in that this gate member maintains at least one edge portion 13*a* of the mattress 13 in an upwardly folded position so that, when the patient is being washed or given a shower, this upwardly folded edge portion 13*a* of the mattress 13 serves as a splashguard for intercepting the water splashes.

To carry away the water thus collected and to prevent the same from flowing over any edge of the mattress 13, the mattress 13 proper has an outlet 14, through which water can escape downwardly. Finally, to allow the unimpeded transfer of a patient to or from the mattress 13, the gate in its lowered or inoperative position releases the mattress-edge portion 13*a* so that the latter can be folded down from its raised position.

To prevent during washing or shower-bathing any splashing even if the water pressure is high and the service personnel is moving about the table, all the mattress-edge portions 13*a*, 13*b*, 13*c* and 13*d* are maintained in a folded-up position by means of the various gates 8, 9, 10 and 11, thereby changing the mattress 13 into a tray from which the water is discharged through the mattress outlet 14.

To provide a convenient water discharge, the mattress 13 is sloping (owing to the slope of the table plate 7) downwardly toward the mattress outlet 14 which is disposed near the footend of the mattress and substantially centrally between the longitudinally extending mattress-edge portions 13*a*, 13*b*.

The water which is collected can suitably flow downward beneath the table plate. This is facilitated in that the mattress outlet comprises a downwardly directed discharge pipe 14, preferably a hose portion welded to the mattress 13 and extending through a hole in the table plate 7. The pipe 14 may extend a sufficient distance downwardly beneath the table plate 7 so that a hose (not shown) or the like may be connected to the lower end of the pipe 14 so as to discharge water directly from the mattress outlet, for instance directly to a draining gutter (not shown). Such a discharge hose, however, can often be dispensed with, since it will be sufficient to place the table plate 7 in a position to cause its outlet 14 to be disposed above a so-called emptying bowl (not shown) or a water closet (not shown).

To allow a rapid positioning of the mattress 13 on the table plate 7, the mattress is provided with at least one pair of attachment members 15 for fixing the mattress 13 to the table plate 7 and comprising hook elements 16 (preferably of a rigid material) which, on the one hand, grips about the side edge of the table plate 7 over which a patient is passed when being transferred to and from the mattress 13, and on the other hand, grips about the side edge opposite this side edge. One simple type of attachment member 15 comprises an extensible portion 17 which is resiliently extended when the two hook elements 16 are hooked onto the table plate 7. Each extensible portion 17 is secured to the mattress 13 by an attachment strip 18 and the hook elements 16 are fastened in turn to the portion 17. To prevent not only a displacement of the mattress 13 but also any twisting or turning movement of the mattress 13 relative to the table plate 7 each attachment member 15 is elongated in shape and extends in spaced parallel relation to an adjacent mattress edge.

To allow a rapid adjustment of the movable gates 10, 11 into a position in which the respective edge portions of the mattress extend upwardly, each holder 12 has a locking device 19 articulated thereto and is biased by a spring 20 or the like to snap automatically upwards to grip the table plate 7 as the gate is moved upwardly to its operative position, whereas, by operating a thumb lever 21, the locking device can be released from this position to allow a lowering of the gates. To allow service personnel only, but not a patient lying on the table, to disconnect and fold down the gate 10, 11 in question, each gate is mounted in two such holders 12 which are spaced by a fairly substantial distance from each other.

In order to allow the table plate 7 or the mattress 13 thereon, if any, to be brought into close proximity of a patient, even if the latter is lying in a bed, for example, and spaced from the side edge of the bed, the holder 12 is pivotally mounted in a bearing device 22 which is disposed beneath the table plate 7 and substantially spaced from the nearest side edge. Because of this arrangement, when the gate 10, 11 is lowered, a large space beneath the table plate 7 will be liberated, extending from the bearing device 22 and outwardly, and in addition this space can be increased by swinging the holder 12 together with the gate inwardly past its position of equilibrium when in its lowered condition.

FIG. 2 illustrates the patient-conveyance table moved into position side by side with a diagrammatically indicated bed 23 from which a patient (not shown) is to be transferred onto the mattress 13. As appears from this Figure, the table plate 7 together with the mattress 13 can be moved a substantial distance inwardly above the bed 23 which will greatly facilitate the transfer. The patient can be pulled or rolled over onto the mattress 13, the edge portion **13*b* lying flat so as not to impede the transfer. When the patient has been transferred onto the mattress, the gate 11 is raised while folding the edge portion 13*b* of the mattress 13 upwardly thereby imparting to this edge portion a shape similar to that of the already folded-up edge portion 13*a***.

The table plate 7, shown in the drawings to be of the cantilever type, is tiltably connected to the plunger 5 of the lifting device 3 of the carriage 1 by means of a suspension bracket. As an alternative to such a mobile arrangement, the table plate could also be mounted on a stationary support with or without a lifting device.

The gate members may be constituted of handle-forming gates, or they may be of any other suitable form, for instance in the form of suitably curved shields. Irrespective of the form of gate members employed, they should advantageously be tilting more or less outwardly in their operative safety-barrier positions, whereby the mattress 13 will curve smoothly along its edge portions.

The arrangement according to the invention may be associated with different kinds of table plates, and the configuration of elements forming part thereof may be varied without departing from the scope of the appended claims.

What is claimed is:

1. A supporting table for a recumbent patient, comprising:

supporting chassis means;

a table plate mounted on said chassis means, and including a head edge, a foot edge, and side edges;

a plurality of gate members, one mounted along each of said edges of said table plate in an erect position extending upwardly from the plane of said plate;

means mounting the gate member along at least one of said side edges for pivotal movement between said erect position, and an inoperative position disposed beneath the plane of said table plate;

a mattress received on said table plate, and including a central portion, a head portion, a foot portion, and side portions, said head, foot and side portions being supported in upwardly extending relationship relative to said central portion by said erect gate members whereby said mattress forms a trough, said mattress side portion supported by said downwardly pivotable side gate member being adapted to fold downwardly when said gate member is lowered to its inoperative position;

drain means connected with said mattress for draining liquid from the trough formed by said mattress, said drain means emptying below said table plate, and said central portion of said mattress being arranged to slope toward said drain means to facilitate removal of said liquid; and at least one pair of attachment members carried by said mattress and adapted to detachably secure said mattress to said table plate, said attachment members including first hook means adapted to grip a first one of said side edges, and second hook means adapted to grip the other of said side edges, whereby said mattress will remain in place on said table plate as a patient is transferred to or from said supporting table.

2. A patient-supporting table according to claim 1, wherein each attachment member includes a resilient portion connected with said hook means, and which is an extended state when the hook means are hooked to the opposite side edges of said table plate.

3. A patient-supporting table according to claim 2, wherein each attachment member is elongated, and extends in parallel relation to its associated side edge of the mattress.

4. A patient-supporting table according to claim 1, wherein said means mounting said pivotally movable gate member comprises: at least one pivotally mounted holder having a locking device pivoted thereto, said locking device being urged by at least one spring member so as to snap automatically into engagement with the table plate when the gate member is moved upwardly to its raised operative erect position, and being releasable from this engaging position for lowering the gate member by manually actuating a thumb-grip operating lever portion of said locking device.

5. A patient-supporting table according to claim 4, wherein both of said side gate members are pivotally mounted, and each side gate member is connected with the table plate through at least two holders disposed in spaced apart relationship.

6. A patient-supporting table according to claim 1, wherein said means mounting the pivotally movable side gate member includes: at least one holder connected to the table plate through bearing means disposed at a substantial distance inwardly of the associated side edge of the table plate, whereby said holder and said side gate member can be swung downwardly and inwardly away from the area of said side edge.

7. A patient-supporting table according to claim 1, wherein each gate member is constructed as a protective barrier which also constitutes an operating handle.

8. A supporting table for a recumbent patient, comprising:

supporting chassis means;

a table plate mounted on said chassis means, and including a head edge, a foot edge, and side edges;

at least one gate member; and means for mounting said gate member along one of the side edges of said table plate for movement between an erect position wherein it extends upwardly from the plane of said plate, and an inoperative position disposed beneath the plane of said plate, said means comprising: at least one generally L-shaped holder, the end of one leg of said holder being pivotally mounted to the underside of said table plate by bearing means spaced substantially inwardly from the associated side edge of said plate, and the other leg of said holder being directed outwardly and upwardly and having said gate member mounted thereon, whereby said holder can be pivoted to move said gate member between its erect position and its inoperative position, both said gate member and said holder being spaced substantially back from the associated side edge of said table plate when said gate member is in its inoperative position; and latch means on said holder, adapted to detachably engage the associated side edge of said table plate to secure said gate member in its erect position.

9. A patient-supporting table according to claim 8, including at least two L-shaped holders arranged in spaced relationship, and each including a latch means.

10. A patient-supporting table according to claim 8, including a second gate member pivotally mounted along the other side edge of said table plate in a manner identical to said first-mentioned gate member, and third and fourth gate members mounted on said head and foot edges of said table plate, respectively, to extend upwardly from the plane thereof.

11. A patient-supporting table according to claim 10, wherein said table plate is sloped downwardly from the head end to the foot end thereof, and including additionally: a mattress received on said table plate, and including a central portion, a head portion, a foot portion, and side portions, said head, foot and side portions being supported in upwardly extending relationship relative to said central portion by said erect gate members whereby said mattress forms a trough.

12. A patient-supporting table according to claim 11, including additionally drain means connected with said mattress for draining liquid from the trough formed by said mattress, said drain means being located near the foot end of said table plate and emptying therebelow.

* * * * *